US006957803B2

(12) United States Patent
Voegeli Jr. et al.

(10) Patent No.: US 6,957,803 B2
(45) **Date of Patent: *Oct. 25, 2005**

(54) SLIM PANTOGRAPH JACK WITH BEARING SPACER

(75) Inventors: Anthony P. Voegeli Jr., Fort Wayne, IN (US); John Joseph McDonald, Albion, IN (US)

(73) Assignee: Dura Global Technologies, Inc., Rochester Hills, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/936,208

(22) Filed: Sep. 8, 2004

(65) Prior Publication Data

US 2005/0127342 A1 Jun. 16, 2005

Related U.S. Application Data

(63) Continuation-in-part of application No. 10/737,390, filed on Dec. 15, 2003, now Pat. No. 6,799,749.

(51) Int. Cl.[7] ..... B66F 3/08
(52) U.S. Cl. ..... 254/126; 254/122
(58) Field of Search ..... 254/126, 122, 254/8 B, 9 B, 10 B, 124, 98

(56) References Cited

U.S. PATENT DOCUMENTS 5,529,286 A * 6/1996 Kikuchi ..... 254/126
6,161,816 A * 12/2000 Kikuchi ..... 254/126
6,799,749 B1 * 10/2004 Voegeli et al. ..... 254/126

* cited by examiner

*Primary Examiner*—Lee D Wilson
(74) *Attorney, Agent, or Firm*—Richard M. Mescher; Porter Wright; Dean B. Watson

(57) ABSTRACT

A pantograph jack includes a base, a load rest, first and second lower arms each pivotably coupled at a first end to the base, and first and second upper arms each pivotably coupled at a first end to the load rest. Second ends of the first lower and upper arms are pivotably coupled at a first joint. Second ends of the second lower and upper arms are pivotably coupled at a second joint. A screw extends between the joints and operably moves the joints toward and away from each other upon rotation of the screw to raise and lower the load rest. A bearing spacer includes a flange forming a bearing engagement surface at a first end and a second end engaging the second joint. The drive screw has an abutment facing the bearing engagement surface. A bearing is located between the bearing engagement surface and the abutment.

20 Claims, 9 Drawing Sheets

SLIM PANTOGRAPH JACK WITH BEARING SPACER

CROSS-REFERENCE TO RELATED APPLICATIONS

This application is a continuation-in-part of patent application Ser. No. 10/737,390 filed on Dec. 15, 2003, now U.S. Pat. No. 6,799,749, the disclosure of which is expressly incorporated herein in its entirety by reference.

STATEMENT REGARDING FEDERALLY SPONSORED RESEARCH

Not Applicable

REFERENCE TO MICROFICHE APPENDIX

Not Applicable

FIELD OF THE INVENTION

The present invention generally relates to a portable lifting jack, and more particularly, a pantograph or scissors-type lifting jack for motor vehicles.

BACKGROUND OF THE INVENTION

A portable jack is often stored in a motor vehicle to enable a driver to lift the vehicle to effect emergency repairs such as, for example, changing a tire. One type of portable jack for automobiles is a pantograph scissors jack. Pantograph jacks typically have four arms hinged at four joints to form a parallelogram or pantograph. One joint is formed on a base which rests on the ground while another is positioned at a load rest located vertically above the base. The other two joints are free floating and are located on a horizontal diagonal at opposite sides of the parallelogram formed by the arms. When the free floating joints are drawn together, the arms extend vertically to lift the load support relative to the base. The position of the free floating joints, and thus the load support, is controlled by a drive screw or threaded shaft which links them together.

There is continuing emphasis by automobile manufacturing companies to reduce the size and weight of components. In turn, jack manufacturing companies are continuously attempting to reduce the size and weight of jacks while still providing adequate strength to bear required loads. Jack manufacturers are also continuously attempting to improve the performance and life of jacks. Accordingly, there is a continuing need for an improved jack for use with motor vehicles.

SUMMARY OF THE INVENTION

The present invention provides a pantograph jack which overcomes at least some of the above-noted problems of the related art. According to the present invention, a pantograph jack comprises, in combination, a base, a load rest, first and second lower arms each pivotably coupled at a first end thereof to the base, and first and second upper arms each pivotably coupled at a first end thereof to the load rest. Second ends of the first lower arm and the first upper arm are pivotably coupled at a first joint including a first axle forming a lateral pivot axis of the second joint. Second ends of the second lower arm and the second upper arm are pivotably coupled at a second joint including a second axle forming a lateral pivot axis of the second joint. The first and second joints are disposed on a substantially horizontal diagonal of a parallelogram formed by the first and second lower arms and the first and second upper arms. A drive screw extends between the first and second joints and operably moves the first and second joints toward and away from each other upon rotation of the drive screw about a longitudinal axis of the drive screw coaxial with the diagonal. A bearing spacer includes a main body having a passage through which the drive screw extends and has a flange at a first end which forms a bearing engagement surface. A second end of the main body of the bearing spacer engages the second axle. The drive screw has an abutment facing the bearing engagement surface. A bearing has an opening coaxial with the drive screw and receives the drive screw therethrough. The bearing is located between the bearing engagement surface and the abutment.

From the foregoing disclosure and the following more detailed description of various preferred embodiments it will be apparent to those skilled in the art that the present invention provides a significant advance in the technology of jacks. Particularly significant in this regard is the potential the invention affords for providing a high load bearing, high quality, light weight, relatively small, low cost assembly. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
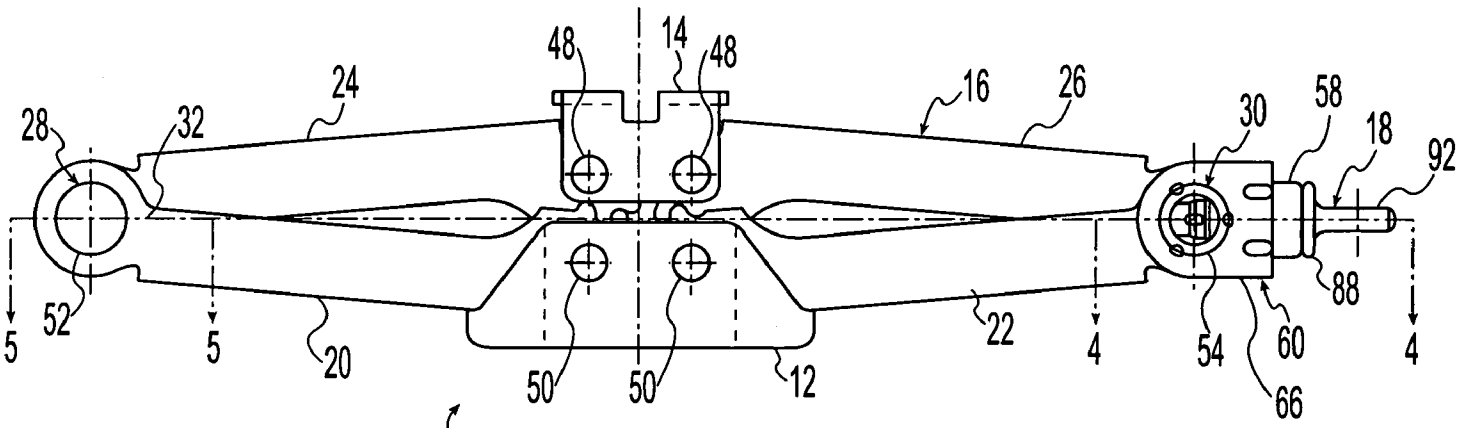
FIG. 1 is an elevational view of a pantograph jack according a preferred embodiment of the present invention, wherein the jack is in a lowered or retracted condition.
Figure 2:
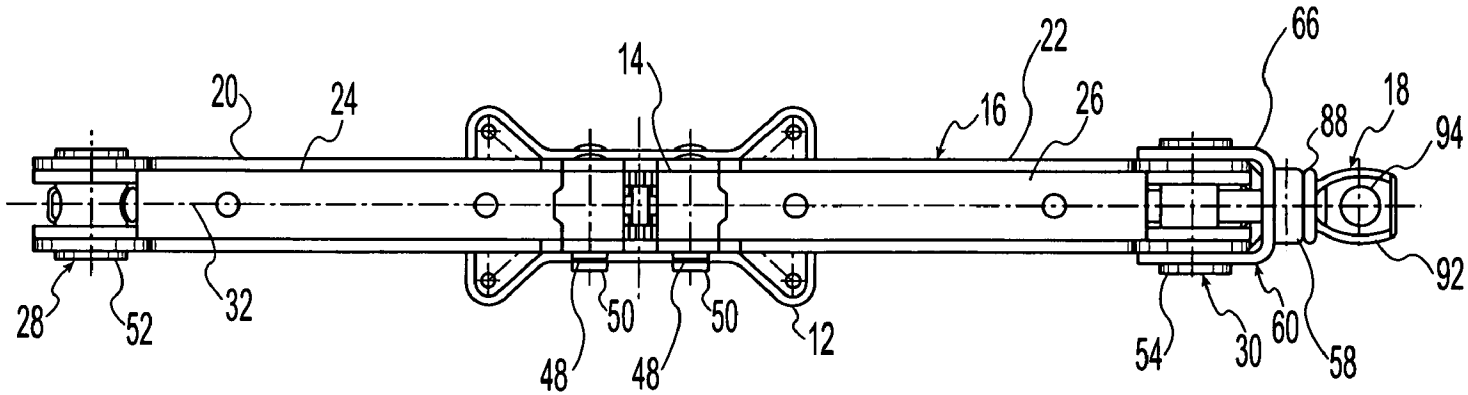
FIG. 2 is a top plan view of the pantograph jack of FIG. 1.

It should be understood that the appended drawings are not necessarily to scale, presenting a somewhat simplified representation of various preferred features illustrative of the basic principles of the invention. The specific design features of the pantograph jack as disclosed herein, including, for example, specific dimensions, orientations, and shapes of the bearing and arms. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the pantograph jack illustrated in the drawings. In general, up or upward refers to an upward direction generally in the plane of the paper in FIG. 1 and down or downward refers to a downward direction generally in the plane of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the improved pantograph jack disclosed herein. The following detailed discussion of various alternative and preferred embodiments will illustrate the general principles of the invention with reference to a jack for a motor vehicle. Other embodiments suitable for other applications will be apparent to those skilled in the art given the benefit of this disclosure.

Referring now to the drawings, FIGS. 1 to 5 show a pantograph jack 10 for a motor vehicle, such as an automobile, according to a preferred embodiment of the present invention. While the illustrated embodiments of the present invention are particularly adapted for use with an automobile, it is noted that the present invention can be utilized with any motor vehicle having a use for a jack including trucks, buses, vans, recreational vehicles, earth moving equipment and the like, off road vehicles such as dune buggies and the like, air borne vehicles, and water borne vehicles.

The illustrated pantograph jack 10 includes a stationary base 12 for engaging a ground support to support the jack 10 on the ground support, a load rest 14 for positioning under and engaging a motor vehicle or other load to be raised and lowered by the jack 10, a pantograph 16 operably connecting the base 12 and the load rest 14 for supporting the load rest 14 in a lowered position (shown in FIG. 1) wherein the load rest 14 is in close proximity of the base 12 and a raised position (shown in FIG. 3) wherein the load rest 14 is remote of the base 12, and a drive assembly 18 for moving the load rest 14 between the raised and lowered positions.

The pantograph 16 includes first and second lower arms 20, 22 each having one end pivotably connected to the base 12 and first and second upper arms 24, 26 each having one end pivotably connected to the load rest 14. The other ends of the first lower arm 20 and the first upper arm 24 are pivotably connected at a first joint 28 and the other ends of the second lower arm 22 and the second upper arm 26 are pivotably connected at a second joint 30. The illustrated arms 20, 22, 24, 26 are substantially the same length so that the first and second joints 28, 30 are located along a generally horizontal diagonal 32 of the pantograph 16.

Figure 6:
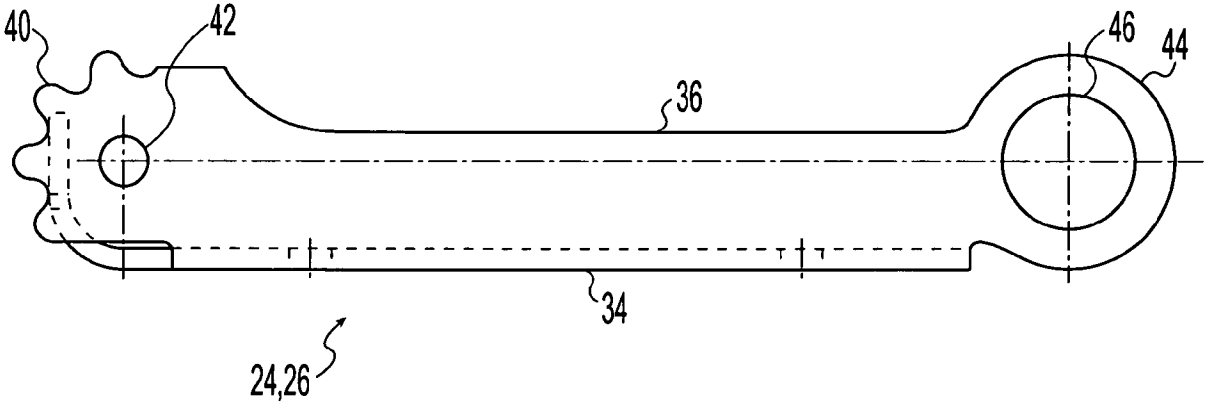
FIG. 6 is an elevational view of an upper arm of the pantograph jack of FIGS. 1 to 5.
Figure 7:
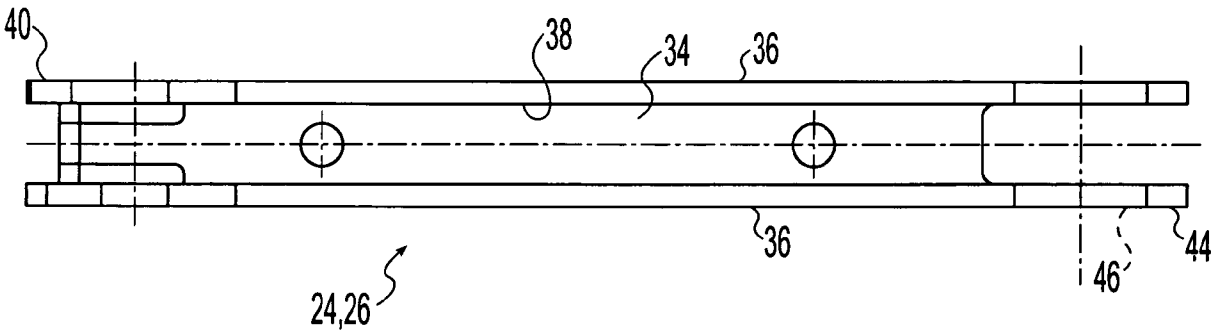
FIG. 7 is a bottom plan view of the upper arm of FIG. 6.

As best shown in FIGS. 6 and 7, the illustrated first and second upper arms 24, 26 are each fabricated from a sheet by stamping and forming t the appropriate shape. The illustrated upper arms 24, 26 are U-shaped in cross section having a main wall 34 and a pair of side walls 36 perpendicularly extending from edges of the main wall 34 to form a channel 38. At a first end of the upper arms 24, 26 which are to be connected at the load rest 14, the side walls 36 are provided with teeth 40 sized and shaped to cooperate with the teeth 40 of the other upper arm 24, 26. The first end also has lateral facing and coaxial openings 42. At a second end of the upper arms 24, 26 to be connected at the first and second joints 28, 30, the side walls 36 are provided with flanges 44 having lateral facing and coaxial openings 46. It is noted that the upper arms 24, 26 can alternatively be provided with jaws adapted to be crimped or any other suitable method of securing the upper arms 24, 26 at the first and second joints 28, 30. The first and second lower arms 20, 22 are substantially the same as the first and second upper arms 24, 26 except that they are sized and shaped to closely receive the upper arms 24, 26 in their respective channels 38, that is, the side walls 36 of the lower arms 20, 22 are spaced apart a greater lateral width than the side walls 36 of the upper arms 24, 26.

As best shown in FIGS. 1 to 5, the first ends of the first and second upper arms 24, 26 are pivotally connected to the load rest 14 by a pair of spaced-apart pins or trunions 48. The trunions 48 extend through the openings 42 in the first ends of the upper arms 24, 26. The trunions 48 can be held in place in any suitable manner such as, for example, staking or otherwise deforming, spinning, clipping or otherwise fastening, heads or flanges, or the like. With the first and second upper arms 24, 26 connected to the load rest 14, the teeth 40 of the first and second upper arms 24, 26 mesh together and the upper arms 24, 26 pivot about the laterally extending axes of the trunions 48 in a synchronized manner. The first ends of the first and second lower arms 20, 22 are pivotally connected to the base 12 by a pair of spaced-part pins or trunions 50. The trunions 50 extend through the openings 46 in the first ends of the lower arms 20, 22. The trunions 50 can be held in place in any suitable manner such as, for example, staking or otherwise deforming, spinning, clipping or otherwise fastening, heads or flanges, or the like. With the first and second lower arms 20, 22 connected to the base 12 by the trunions 50, the teeth 40 of the first and second lower arms 20, 22 mesh together and the lower arms 20, 22 pivot about the laterally extending axes of the trunions 50 in a synchronized manner.

The second ends of the first upper arm 24 and the first lower arm 20 are pivotally connected together by a pin or axle such as a trunion 52 to form the first joint 28. The trunion 52 extends through the openings 46 in the flanges 44 of the first upper arm 24 and first lower arm 20. The trunion 52 can be held in place in any suitable manner such as, for example, staking or otherwise deforming, spinning, clipping or otherwise fastening, heads or flanges, or the like. With the first upper arm 24 and first lower arm 20 connected in this manner, the arms 20, 24 each pivot about the laterally extending axis of the trunion 52. The second ends of the second upper arm 26 and the second lower arm 22 are pivotally connected together by a pin or axle such as a trunion 54 to form the second joint 30. The trunion 54 extends through the openings 46 in the flanges 44 of the second upper arm 26 and second lower arm 22. The trunion 54 can be held in place in any suitable manner such as, for example, staking or otherwise deforming, spinning, clipping or otherwise fastening, heads or flanges, or the like. With the second upper arm 26 and second lower arm 22 connected in this manner, the arms 22, 26 each pivot about the laterally extending axis of the trunion 54.

The drive assembly 18 includes a drive screw 56, bearing 58, and a bearing support 60. The drive screw 56 is mounted between the first and second joints 28, 30 and rotates about a central axis coaxial with the horizontal diagonal 32 of the pantograph 16. The drive screw 56 has a length sufficient to extend between the first and second joints 28, 30 when the load rest 14 is in the lowered position and is provided with a thread along its free end. The free end of the drive screw 56 threadably engages a threaded opening 62 in the trunion 52 of the first joint 28 so that the trunion 52 moves along the length of the drive screw 56 upon rotation of the drive screw 56 about its central axis 32. While the illustrated trunion 52 of the first joint 28 forms a nut, is noted that a separate nut can alternatively be provided and secured to the trunion 52 in a known manner. The drive screw 56 also extends through an opening 64 in the trunion 54 of the second joint 30.

Figure 4:
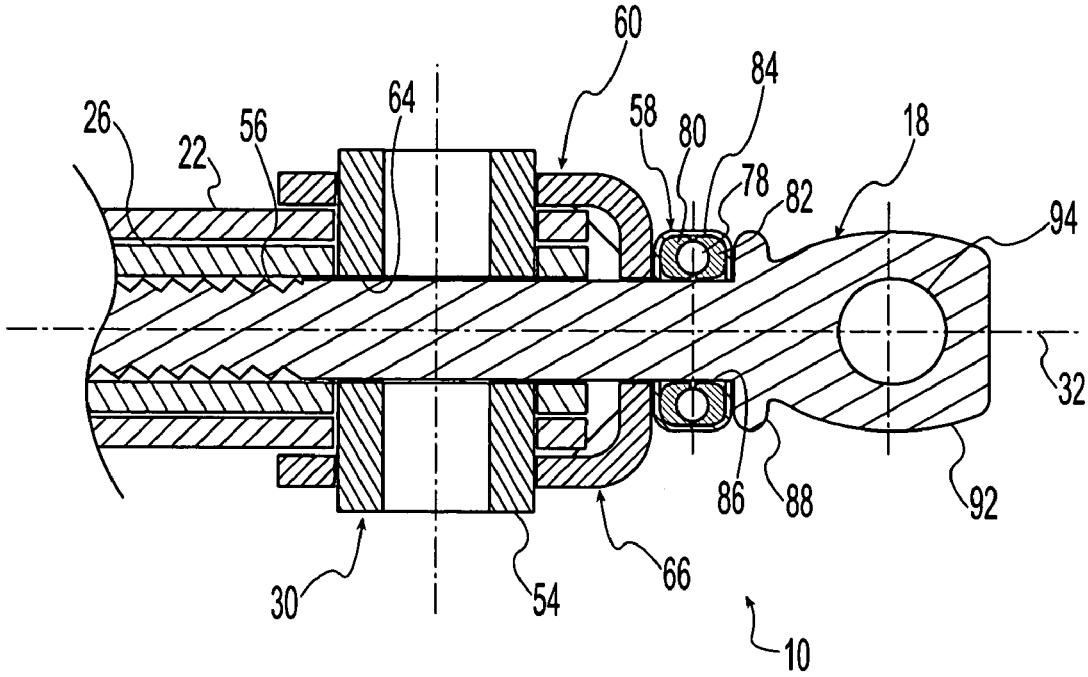
FIG. 4 is a sectional view taken along line 4—4 of FIG. 1.
Figure 5:
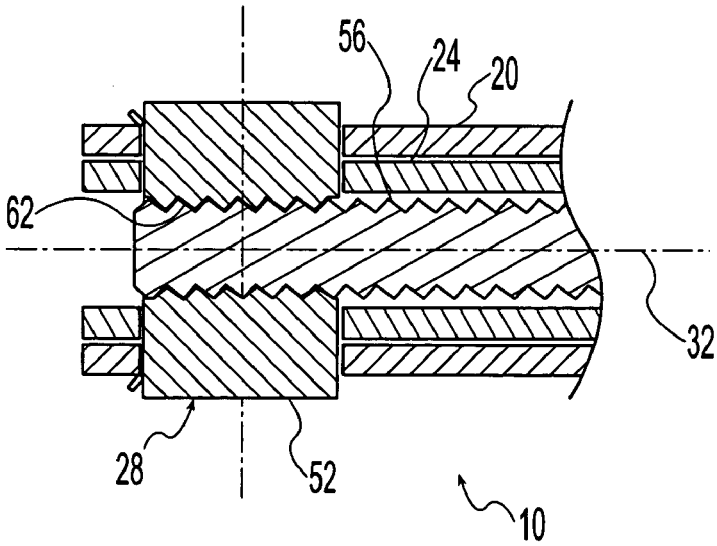
FIG. 5 is a sectional view taken along line 5—5 of FIG. 1
Figure 8:
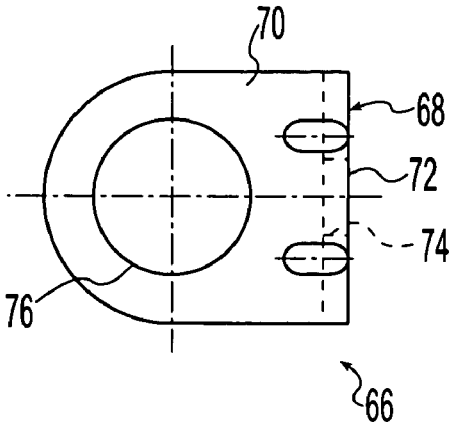
FIG. 8 is a side elevational view of a yoke of the pantograph jack of FIGS. 1 to 5.
Figure 9:
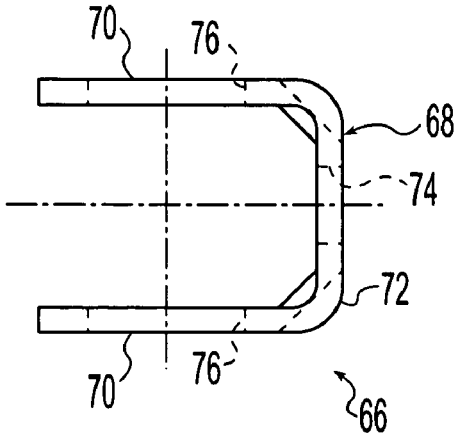
FIG. 9 is a top plan view of the yoke of FIG. 8.
Figure 10:
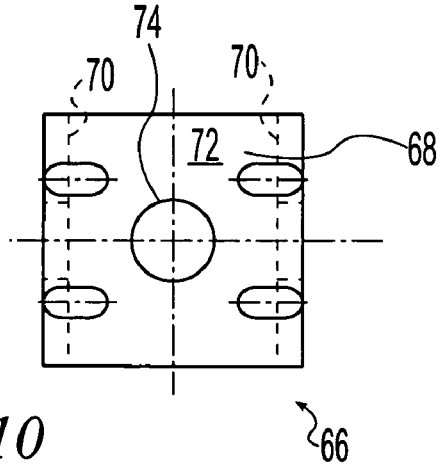
FIG. 10 is an end elevational view of the yoke of FIGS. 8 and 9.

The illustrated bearing support 60 is in the form of a yoke 66 spanning the second ends of the second upper arm 26 and the second lower arm 22 at the second joint 30. As best shown in FIGS. 8 and 9, the illustrated yoke 66 is generally U-shaped having a generally vertical end wall 68 and a pair of generally vertical side walls 70 extending from opposed lateral edges of the end wall 68. The illustrated end wall 68 is sized to space the side walls 70 a lateral width greater than the lateral width of the upper and lower arms 26, 22. The outer side of the end wall 68 forms a bearing engagement surface 72 having a lateral width greater than the lateral widths of the channels 38 of both the second upper arm 26 and the second lower arm 22. The bearing engagement surface is preferably sized to engage substantially all of the face of the bearing 58 and is more preferably sized to engage all of the face of the bearing 58. The end wall 68 is provided with a through opening 74 for passage of the drive screw 56 therethrough. The side walls 70 are provided with laterally facing coaxial openings 76 sized for receiving the trunion 54 of the second joint 30 therein. It is noted that alternatively, the side walls 70 can be provided with jaws to be crimped to the trunion 54. As best shown in FIG. 4, the side walls 70 are sized and shaped to position the end wall 68 at the near end of the second upper arm 26 and the second lower arm 22 outside the channel side walls 36 of the arms 22, 26.

The bearing 58 can be a thrust bearing of any suitable type. The illustrated bearing 58 includes a plurality of rolling elements 78 located between inner and outer races 80, 82 held by a retainer 84. The drive screw 56 extends through a central opening 86 of the bearing 58. An inner side of the bearing 58 engages the bearing engagement surface 72 of the yoke 66 and an outer side of the bearing 58 engages a stop or abutment 88 of the drive screw 56. The illustrated abutment 88 faces the bearing engagement surface 72. It is noted that while the illustrated abutment 88 is unitary with the drive screw 56, the abutment 88 can alternatively be formed by a separate component secured to the drive screw 56. Located in this position, the bearing 58 is sandwiched between the bearing engagement surface 72 and the abutment 88 and located entirely outside the channel 38 of the arms 22, 26 so that no part of the bearing 58 is located between the side walls 36 of the arms 22, 26. This position permits the bearing 58 to have a lateral width greater than the lateral widths of both of the channels 38 of the arms 22, 26. While the illustrated bearing 58 directly engages both the bearing engagement surface 72 and the abutment 88, washers, bushings, spacers or the lock can alternatively be located therebetween in either or both of the locations if desired. The end of the drive screw 56 is provided with a lug 92 having an opening 94 for receiving a crank (not shown) for rotating the drive screw 56.

Figure 3:
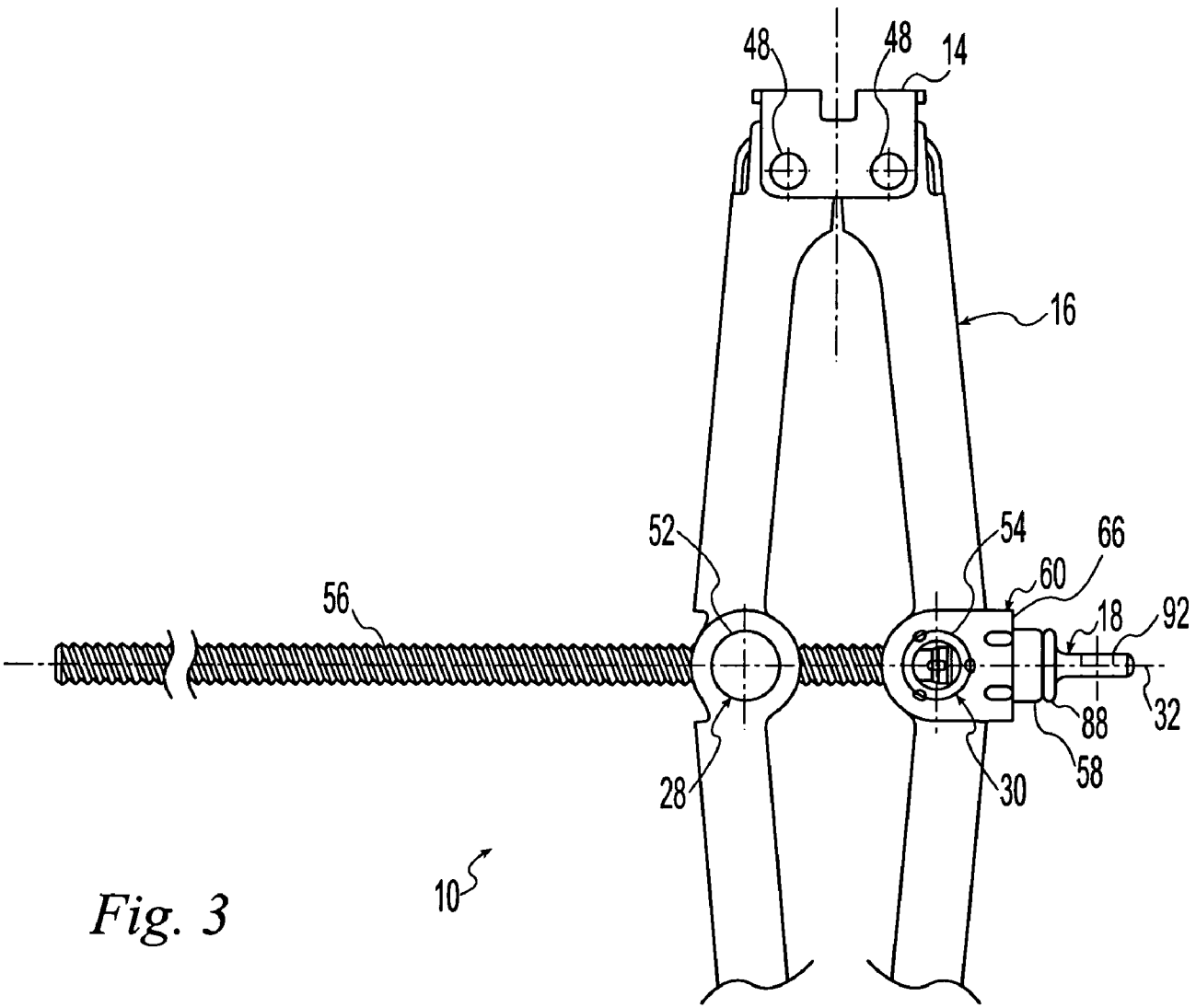
FIG. 3 is a fragmented, elevational view of the pantograph jack of FIGS. 1 and 2, wherein the jack is in a raised or extended condition.

During operation, the jack 10 is positioned so that the load rest 14 is positioned under the item to be lifted with the base 12 positioned on the ground while in the lowered position (FIG. 1). The operator turns the crank to rotate the drive screw 56. The drive screw 56 freely rotates within the second joint 30 without changing the linear position thereof. However, rotation of the drive screw 56 within the first joint 28 moves the first joint 28 linearly along the drive screw 56 to move the first and second joints 28, 30 closer together. As the first and second joints 28, 30 move closer together, the arms 20, 22, 24, 26 pivot to raise the load rest 14 and the item supported thereon to the raised position (FIG. 3). When it is desired to lower the jack 10, the crank is rotated in the opposite direction to move the first and second joints 28, 30 farther apart in a reverse like manner.

Figure 11:
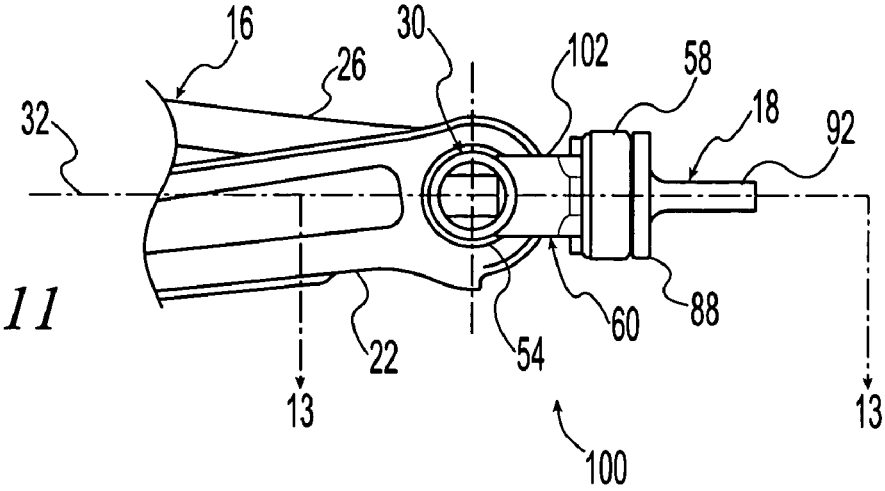
FIG. 11 is a fragmented, side elevational view of a pantograph jack according to a second embodiment of the present invention.
Figure 12:
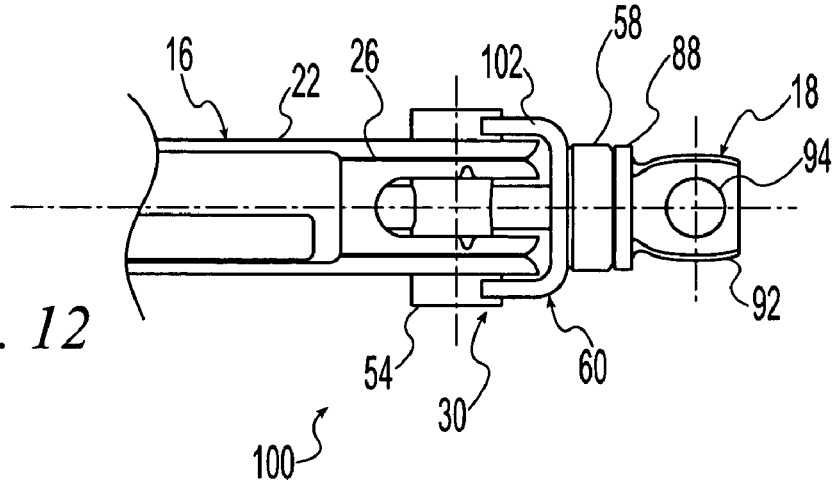
FIG. 12 is a fragmented, top plan view of the pantograph jack of FIG. 11.
Figure 13:
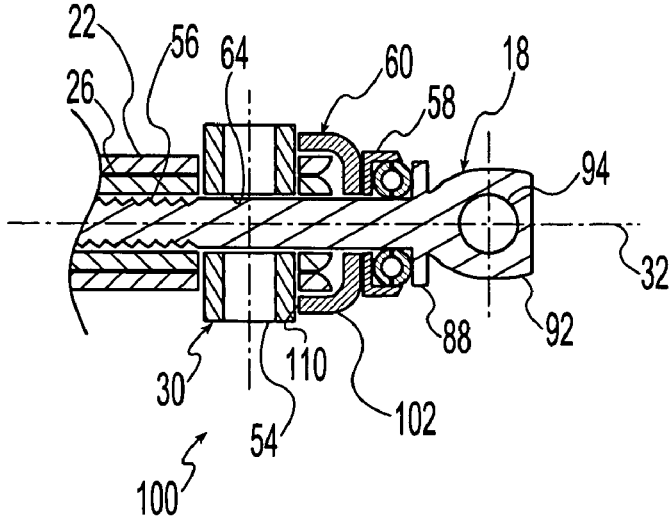
FIG. 13 is a sectional view taken along line 12—12 of FIG. 11.

FIGS. 11 to 13 show a pantograph jack 100 according to a second embodiment of the present invention wherein like references numbers are used to indicate like structure. The jack 100 according to the second embodiment of the invention is substantially the same as the jack 10 according to the first embodiment of the invention described hereinabove except that the bearing support 60 is in the form of a spacer 102 instead of the yoke 66.

Figure 14:
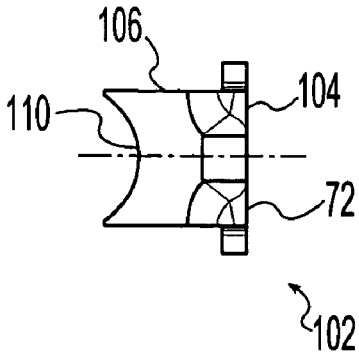
FIG. 14 is a side elevational view of a spacer of the pantograph jack of FIGS. 11 to 13.
Figure 15:
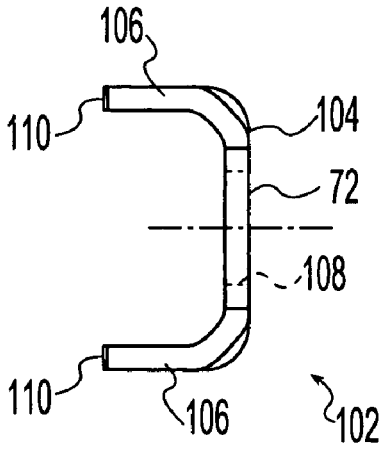
FIG. 15 is a top plan view of the spacer of FIG. 14.
Figure 16:
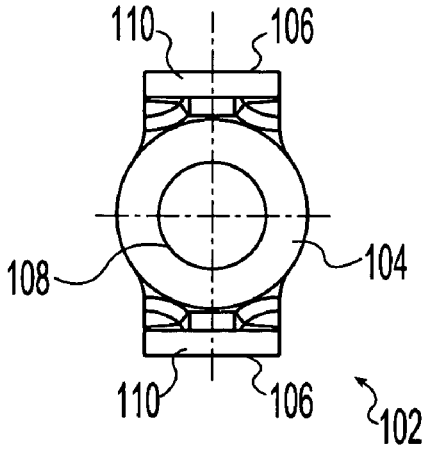
FIG. 16 is an end elevational view of the spacer of FIGS. 14 and 15.

As best shown in FIGS. 14 to 16, the illustrated spacer 102 is generally U-shaped having a generally vertical end wall 104 and a pair of generally vertical side walls 106 extending from opposed lateral edges of the end wall 104. The illustrated end wall 104 is sized to space the side walls 106 a lateral width greater than the lateral width of the upper and lower arms 26, 22. The outer side of the end wall 104 forms the bearing engagement surface 72 having a lateral width greater than the lateral widths of the channels 38 of both the upper arm and the lower arm 22, 26. The end wall 104 is provided with a through opening 108 for passage of the drive screw 56 therethrough. The side walls 106 are provided with longitudinally facing engagement surfaces 110 sized and shaped for engaging the outer surface of the trunion 54 of the second joint 30. The illustrated engagement surfaces 110 are arcuate having a radius substantially equal to the outer surface of the trunion 54 so that the engagement surfaces 110 closely conform to the shape of the outer surface of the trunion 54. It is noted that the engagement surfaces 110 can alternatively have other shapes such as, for example, planar. As best shown in FIGS. 12 and 13, the side walls 106 are sized and shaped to position the end wall 104 at the near end of the second upper arm 26 and the second lower arm 22 outside the channel side walls 36 of the arms 22, 26. While the illustrated spacer 102 and trunion 54 are formed as separate components, it is noted that the spacer 102 and the trunion 54 can alternatively be rigidly secured together or formed as a single unitary component.

Figure 17:
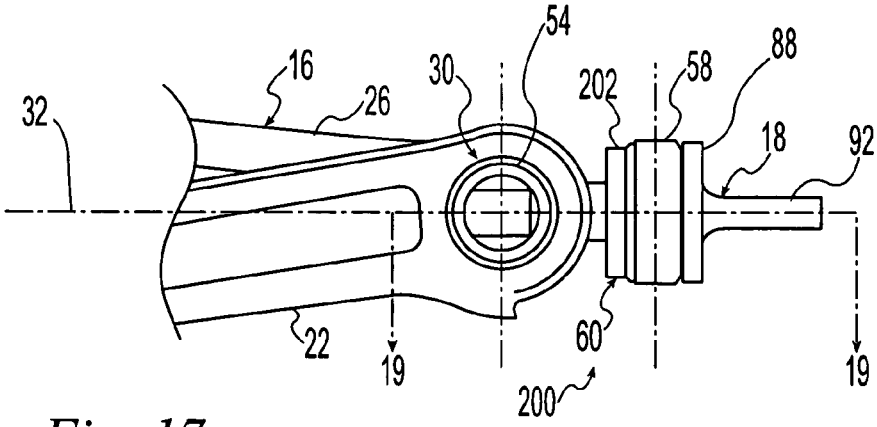
FIG. 17 is a fragmented, side elevational view of a pantograph jack according to a third embodiment of the present invention.
Figure 18:
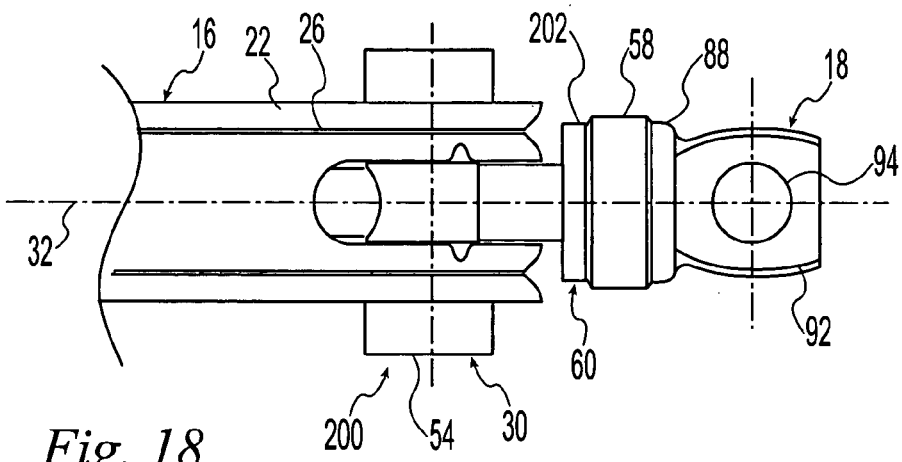
FIG. 18 is a fragmented, top plan view of the pantograph jack of FIG. 17.
Figure 19:
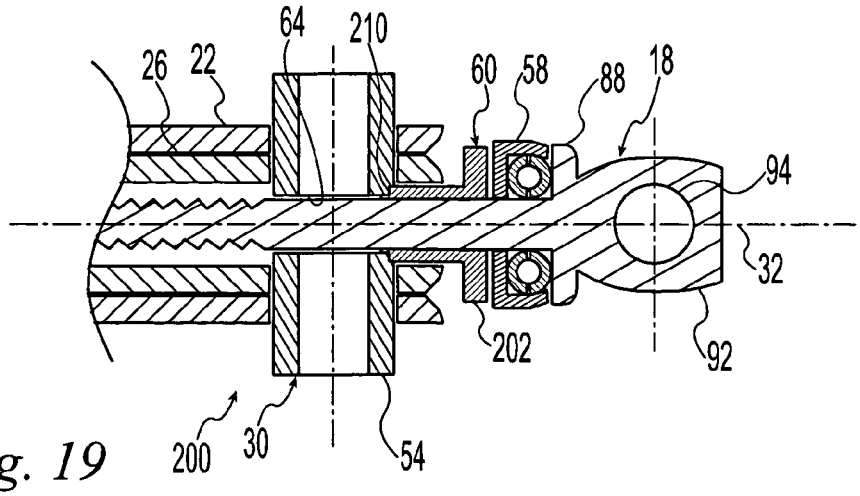
FIG. 19 is a sectional view taken along line 18—18 of FIG. 17.

FIGS. 17 to 19 show a pantograph jack 200 according to a third embodiment of the present invention wherein like references numbers are used to indicate like structure. The jack 200 according to the third embodiment of the invention is substantially the same as the jacks 10, 100 according to the first and second embodiments of the invention described hereinabove except that the bearing support 60 is in the form of a spacer or bushing 202 instead of the yoke 66 or the spacer 102.

Figure 20:
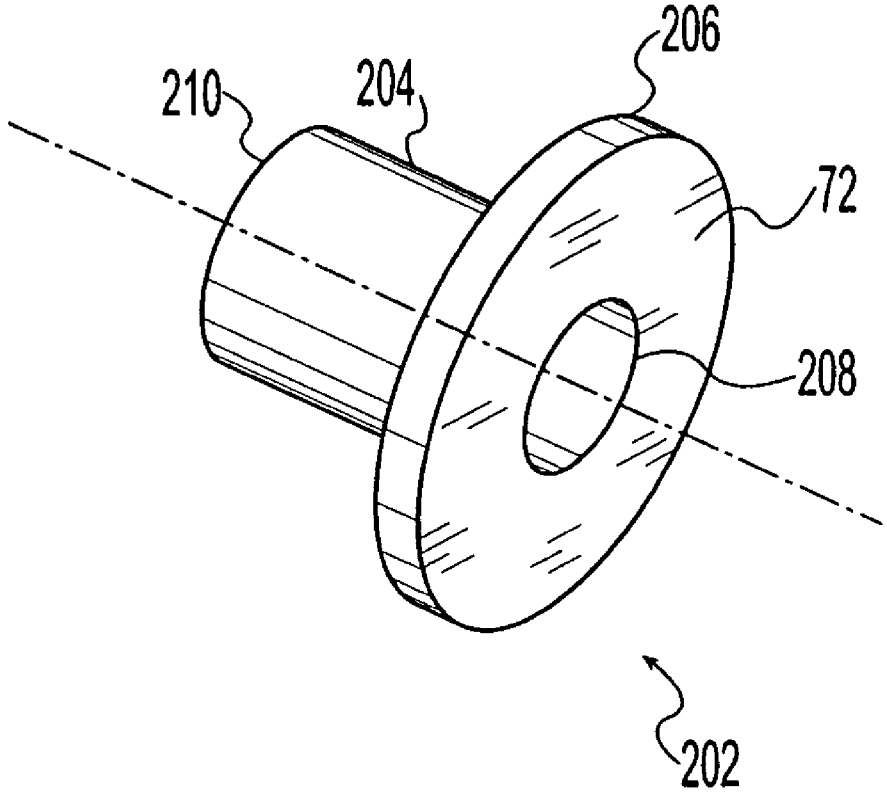
FIG. 20 is a perspective view of a flanged bushing of the pantograph jack of FIGS. 17 to 19.
Figure 21:
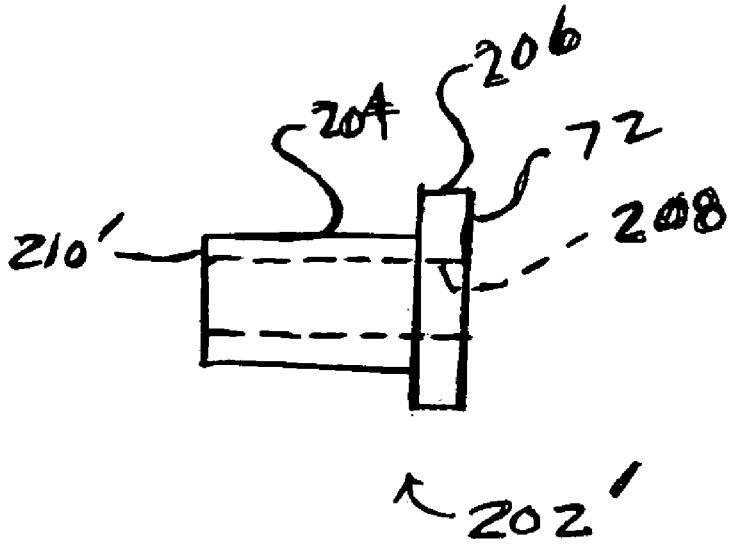
FIG. 21 is a side view of an alternative flanged spacer for use with the pantograph jack of FIGS. 17 to 19.

As best shown in FIG. 20, the illustrated spacer or bushing 202 has a tubular-shaped main body 204 with a disc-shaped flange 206 located at an outer or second end. The illustrated outer diameter of the flange 206 is larger than the outer diameter of the main body 204. The main body 204 has an outer diameter sized to fit between the side walls 36 of the second upper arm 26. The main body 204 has a longitudinally extending passage 208 sized for receiving the drive screw 56 therethrough. An inner or first end of the main body 204 forms a trunion or abutment or engagement surface 210. The illustrated trunion engagement surface 210 is arcuate having a radius substantially equal to the outer surface of the trunion 54 so that the engagement surface 210 closely conforms to the shape of the outer surface of the trunion 54. It is noted that the engagement surface 210 can alternatively have other shapes. For example, the alternative spacer 202' shown in FIG. 21 has a trunion engagement surface 210' which is substantially planar. The flange 206 is located at the outer end of the main body 204 and is preferably sized to form the bearing engagement surface 72 having a lateral width greater than the lateral widths of the channels 38 of both the upper arm 26 and the lower arm 22. As best shown in FIGS. 18 and 19, the main body 204 extends into the channel 38 so that the engagement surface 210 engages the trunion 54 within the channel 38 between the side walls 36 of the upper arm 26. While the illustrated bushing 202 and trunion 54 are formed as separate components, it is noted that the bushing 202 and the trunion 54 can alternatively be rigidly secured together or formed as a single unitary component.

It is noted that each of the features of the various disclosed embodiments can be utilized with each of the others embodiments. For example, the spacer of the second embodiment can alternatively extend to the trunion between the sides walls of the upper bracket like the spacer or bushing of the third embodiment.

From the above detailed disclosure it should be appreciated that the jacks 10, 100, 200 according to the present invention provide a bearing support 60 forming an engagement surface 72 outside the channels 38 of the arms 22, 26 so that the arms 20, 22, 24, 26 can be sized as desired rather than sized to receive the bearing 58 therein. Thus the arms 20, 22, 24, 26 can be sized with a reduced lateral width which reduces weight, package size and cost of the jacks 10, 100, 200.

From the foregoing disclosure and detailed description of certain preferred embodiments, it will be apparent that various modifications, additions and other alternative embodiments are possible without departing from the true scope and spirit of the present invention. For example, it will be apparent to those skilled in the art, given the benefit of the present disclosure, that the bearing 58 and the bearing support 60 can each have many different configurations and can be formed of many different materials. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. A pantograph jack comprising, in combination:

a base;

a load rest;

first and second lower arms each pivotably coupled at a first end thereof to the base;

first and second upper arms each pivotably coupled at a first end thereof to the load rest;

wherein second ends of the first lower arm and the first upper arm are pivotably coupled at a first joint including a first axle forming a lateral pivot axis of the second joint;

wherein second ends of the second lower arm and the second upper arm are pivotably coupled at a second joint including a second axle forming a lateral pivot axis of the second joint;

wherein the first and second joints are disposed on a substantially horizontal diagonal of a parallelogram formed by the first and second lower arms and the first and second upper arms;

a drive screw extending between the first and second joints and operably moving the first and second joints toward and away from each other upon rotation of the drive screw about a longitudinal axis of the drive screw coaxial with the diagonal;

a bearing spacer including a main body having a passage through which the drive screw extends and having a flange at a first end which forms a bearing engagement surface;

wherein a second end of the main body of the bearing spacer engages the second axle;

wherein the drive screw has an abutment facing the bearing engagement surface;

a bearing having an opening coaxial with the drive screw and receiving the drive screw therethrough; and wherein the bearing located between the bearing engagement surface and the abutment.

2. The pantograph jack according to claim 1, wherein the bearing is a thrust bearing.

3. The pantograph jack according to claim 2, wherein the bearing includes an inner race, an outer race, and a plurality of rolling elements between the inner and outer races, and wherein the outer race rotates with the drive screw.

4. The pantograph jack according to claim 1, wherein the second axle is a trunion.

5. The pantograph jack according to claim 1, wherein the bearing engagement surface has a lateral width greater than a lateral width of at least one of the second lower arm and the second upper arm.

6. The pantograph jack according to claim 5, wherein the bearing engagement surface is located along the central axis and outwardly spaced from the second lower arm and the second upper arm.

7. The pantograph jack according to claim 1, wherein the bearing engagement surface is located along the central axis and outwardly spaced from the second lower arm and the second upper arm.

8. The pantograph jack according to claim 1, wherein the bearing has a lateral width greater than a lateral width of at least one of the second lower arm and the second upper arm.

9. The pantograph jack according to claim 8, wherein the bearing is outwardly spaced from the second lower arm and the second upper arm.

10. The pantograph jack according to claim 1, wherein the bearing is outwardly spaced from the second lower arm and the second upper arm.

11. The pantograph jack according to claim 1, wherein the second lower arm and the second upper arm each form a longitudinally extending channel and wherein the bearing is located outside the channel of the second lower arm and the channel of the second upper arm.

12. The pantograph jack according to claim 11, wherein the bearing has a lateral width greater than a lateral width of the channel of the second lower arm and a lateral width of the channel of the second upper arm.

13. The pantograph jack according to claim 1, wherein flange of the bearing spacer has an outer diameter larger than an outer diameter of the main body of the bearing spacer.

14. The pantograph jack according to claim 1, wherein the main body of the bearing spacer is generally tubular-shaped and the flange portion of the main body is generally disc-shaped.

15. The pantograph jack according to claim 14, wherein the wherein the bearing engagement surface is substantially planar.

16. The pantograph jack according to claim 1, wherein the wherein the bearing engagement surface is substantially planar.

17. The pantograph jack according to claim 1, wherein the flange of the bearing spacer has a lateral width greater than a lateral width of at least one of the second lower arm and the second upper arm.

18. The pantograph jack according to claim 17, wherein the flange of the bearing spacer is outwardly spaced from the second lower arm and the second upper arm.

19. The pantograph jack according to claim 1, wherein the flange of the bearing spacer is outwardly spaced from the second lower arm and the second upper arm.

20. The pantograph jack according to claim 1, wherein the first end of the bearing spacer has a substantially planar axle engagement surface engaging the trunion.

* * * * *